US005272491A

United States Patent [19]

Asakawa et al.

[11] Patent Number: 5,272,491

[45] Date of Patent: Dec. 21, 1993

[54] THERMAL INK JET PRINT DEVICE HAVING PHASE CHANGE COOLING

[75] Inventors: Stuart D. Asakawa, San Diego, Calif.; John A. Mohr, Lincoln, Nebr.; John L. Stoffel, San Diego, Calif.; William D. Kappele, Loveland, Colo.; Bruce E. Mueller, Escondido; Gerold G. Firl, Poway, both of Calif.

[73] Assignee: Hewlett-Packard Company, Palo Alto, Calif.

[21] Appl. No.: 863,521

[22] Filed: Apr. 3, 1992

Related U.S. Application Data

[63] Continuation of Ser. No. 608,057, Oct. 31, 1990, abandoned.

[51] Int. Cl.[5] ..... B41J 2/05

[52] U.S. Cl. ..... 346/140 R; 165/104.33; 361/704; 400/719

[58] Field of Search ..... 346/140 R; 400/719, 400/124 TC; 361/386, 382; 165/104.33

[56] References Cited

U.S. PATENT DOCUMENTS

| | | | |
|---|---|---|---|
| 4,345,262 | 8/1982 | Shirato | 346/140 R X |
| 4,521,805 | 6/1985 | Ayata | 358/296 X |
| 4,542,980 | 9/1985 | Tajima | 355/286 |
| 4,579,469 | 4/1986 | Falcetti | 400/124 |
| 4,680,859 | 7/1987 | Johnson | 29/611 |
| 4,819,011 | 4/1989 | Yokota | 346/76 PH |
| 4,831,390 | 5/1989 | Deshpande | 346/140 |
| 4,879,632 | 11/1989 | Yamamoto | 361/386 |
| 4,894,664 | 1/1990 | Pan | 346/140 X |
| 4,968,160 | 11/1990 | Ishizuka | 400/124 |
| 5,066,964 | 11/1991 | Fukuda | 346/140 R |

FOREIGN PATENT DOCUMENTS

| | | | |
|---|---|---|---|
| 0352726 | 1/1990 | European Pat. Off. | 29/377 |

*Primary Examiner*—Joseph W. Hartary
*Attorney, Agent, or Firm*—E. F. Oberheim

[57] ABSTRACT

A thermal ink jet print device having a phase change material, a solid or fluid, disposed in heat exchange proximity to the thermal ink jet printhead to absorb printhead heat energy by changing physical state at a printhead temperature below that at which unacceptable printing takes place and at a rate commensurate with the rate of heat energy input.

15 Claims, 8 Drawing Sheets

THERMAL INK JET PRINT DEVICE HAVING PHASE CHANGE COOLING

This is a continuation of copending application Ser. No. 07/608,057 filed on Oct. 31, 1990, now abandoned.

TECHNICAL FIELD

This invention relates generally to thermal ink jet print devices having printhead cooling systems.

BACKGROUND OF THE INVENTION

Thermal ink jet print devices such as a print cartridge, for example, are used to print text and images on a media such as paper. Such devices include thermal ink jet printheads, which comprise nozzle or orifice plates mounted on substrates secured to the body of the print device in communication with a supply of ink in an ink chamber or bladder within the body. Small electric heaters, each in the form of a small resistor in the ink passage at each nozzle, when electrically pulsed, heat the ink which is then expelled as a droplet from the nozzle thereat.

Typical nozzle plate structures are described in U.S. Pat. No. 4,694,308, to C. S. Chan et al, filed Nov. 22, 1985, entitled "Barrier Layer and Orifice Plate for Thermal Ink Jet Printhead Assembly", and U.S. Pat. No. 4,812,859, to C. S. Chan et al, filed Mar. 14, 1989, entitled "Multi-Chamber Ink Jet Recording Head for Color Use", particularly FIG. 6. Both patents are assigned to the assignee of this invention and their teachings are incorporated herein by reference.

A typical thermal ink jet print device comprises a printhead having a silicon substrate structure of glass or monocrystalline silicon on which a silicon dioxide barrier layer is deposited. The individual heater resistors are each deposited on the silicon barrier in an ink passage or priming cavity at each nozzle, individual circuit traces for each resistor provide communication with discrete supplies of electrical energy, for firing the resistors in varying sequences which are orchestrated to print selected characters and images, as is well known. Transfer of resistor heat to the ink boils the ink. The expanding bubble ejects an ink droplet from the nozzle thereat. Resistor heat also heats the silicon substrate structure. During high density printing, such as increasing the number of nozzles being fired and/or resolution, say going from 300 dots per inch to 600 dots per inch, or increasing the firing frequency, the printhead tends to get too hot. Thermal ink jet printhead performance is degraded when the printhead temperature is too high. Temperatures at which print quality degrades vary widely, depending upon the ink jet printhead design.

Thermal ink jet print devices frequently employ a plastic body on which the printhead is mounted. Without the provision of a heat sink, to avoid print quality degradation, a print rate limit has to be determined and not exceeded. Other attempts to solve this overheating problem have included an all metal print device body to conduct the heat away, or a metal fin coupled with air convection cooling. The metal acted like a capacitor or bucket, and once the metal had heated sufficiently, print quality degraded. Convection cooling helped to dissipate the heat, but was expensive and required air velocities that adversely affected ink droplet trajectories which degraded print quality. Reducing the drop ejection frequency lowers the heat flux. This keeps the head cooler. It is also possible to employ various print modes in which the pen scans multiple times over a line to create the desired output. For example, if every other nozzle fired, it would take 2 passes to complete a line, etc. This reduces hard copy throughout.

SUMMARY OF THE INVENTION

Improvement over prior art devices and practices is realized according to this invention in the provision of a print device having a heat sink employing a phase change material for absorbing print head thermal energy. The heat sink may comprise a heat pipe containing a circulating phase change material or, in a presently preferred embodiment and best mode for practicing the invention, a solid material disposed in heat exchange relation with the printhead, for example, in proximity to or in contact with the substrate of the printhead. Such a solid phase change material is preferably solid in a temperature environment for the printhead in which acceptable print quality is achieved and melts at a temperature below that at which print degradation takes place. Such a heat sink takes advantage of the heat of fusion of the solid phase change material. A heat pipe is a heat-transfer device comprising a sealed container which contains a small amount of fluid in a partial vacuum. Heat is absorbed at one end in heat exchange relationship with the printhead by vaporization of the fluid and is released at another location on said container, removed from said one end, by condensation of the vapor. The condensate returns along the sides of the sealed container to the original reservoir. Here the heat of vaporization absorbs printhead heat energy.

Heat energy from the printhead is used to change the physical state of the phase change material which by this means is absorbed or given up in thermal energy used in changing the physical state of the material and thereby removed from the substrate and adjacent print body.

When changing the physical state of a material, the thermal energy input to the material, liquid or solid, is used to break down the molecular bonds, and does not appreciably heat up the material. For solids, once the last bit of solid material is melted, of course, the temperature of the melt will begin to rise if the print rate is maintained. With a heat pipe, if the thermal capacity is not exceeded the change in physical state is continuous. Using this phase change principle, the heat generated by the thermal ink jet printhead is used or put to work to change the physical state of a material. The printhead is maintained at a constant acceptable temperature as long as a change in physical state of the material takes place.

It is apparent that the principles of this invention, while explained in connection with a printhead, can be extended and used in cooling integrated circuits and other electrical components.

Additionally, the glass transition of a material is usable for cooling purposes in these applications.

BRIEF DESCRIPTION OF THE DRAWINGS

This invention will be better understood by reference to the following specification when considered in conjunction with the accompanying drawings in which.

BEST MODE FOR CARRYING OUT THE INVENTION

Figure 1:
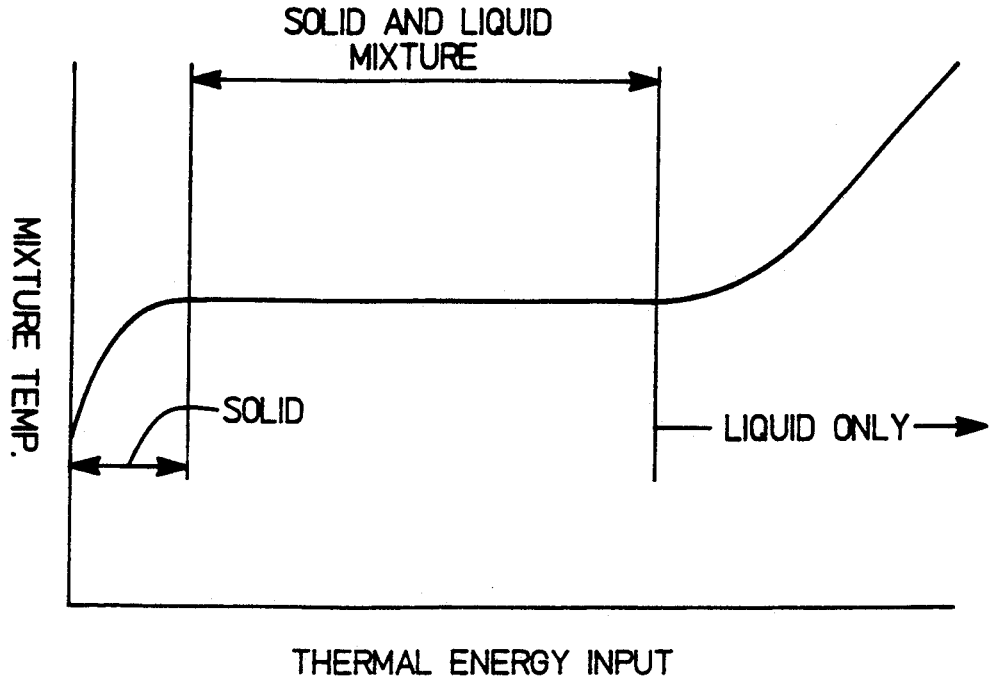
FIG. 1 is a plot of Temperature v Time, typically indicating the thermal energy required in changing the physical state of a solid material to a liquid.

The hard copy throughput potential of many thermal ink jet printers cannot be realized because of overheating of the printhead and consequent degradation of print quality. Print rate can be increased, according to this invention, by employing a heat sink for the printhead in which materials are employed which undergo a change in physical state when subject to printhead upper limit operating temperatures. FIG. 1, which is a plot of Temperature v Time, typically depicting the thermal energy input in changing the physical state of a material, e.g. melting a solid or vaporizing a fluid, plots the relatively constant temperature which exists over a period of time during which the material continuously undergoes a change in physical state. If the material is a solid, once the phase change is complete, if the thermal energy input is not reduced, the temperature of the liquid will rise. During the phase change interval the thermal energy is used to change the physical state.

The use of a heat sink requires space in the print device for receiving the heat sink and placing the phase change material in heat exchange proximity to the printhead. A solid heat sink material is preferably of a thermally conductive material that melts at a printhead temperature at or below that temperature beyond which print quality is unacceptably degraded. Temperature control is provided by the heat sink during that period of time required to achieve the complete change in physical state. The printhead storage capacity for phase change materials provides about four minutes of blackout printing for printheads which have been tested, as will be explained at a later point. Thus many variable print density printing projects can be accommodated which have periodic high print density demands without reducing the print rate in use. This can be further optimized for much longer times.

The use of a finite volume of a solid phase change material within a cavity in the print body, offers a convenient solution to the problem of overheating of the printhead. High density printing intervals however, can be further extended or made continuous by the use of an arrangement in which the phase change material is circulated, as in a heat pipe, a part of which may comprise the body cavity, or, alternatively, the heat pipe may be a self contained unit having hot and cold junctions for heat input and heat output for receiving heat from the printhead at the hot junction and removing heat at the cold junction. The general requirements of materials in this instance, insofar as temperatures at which changes in phase or physical state take place, are the same as for solid material. The advantage of the heat pipe is that the period of temperature control for the printhead is continuous.

Figure 2:
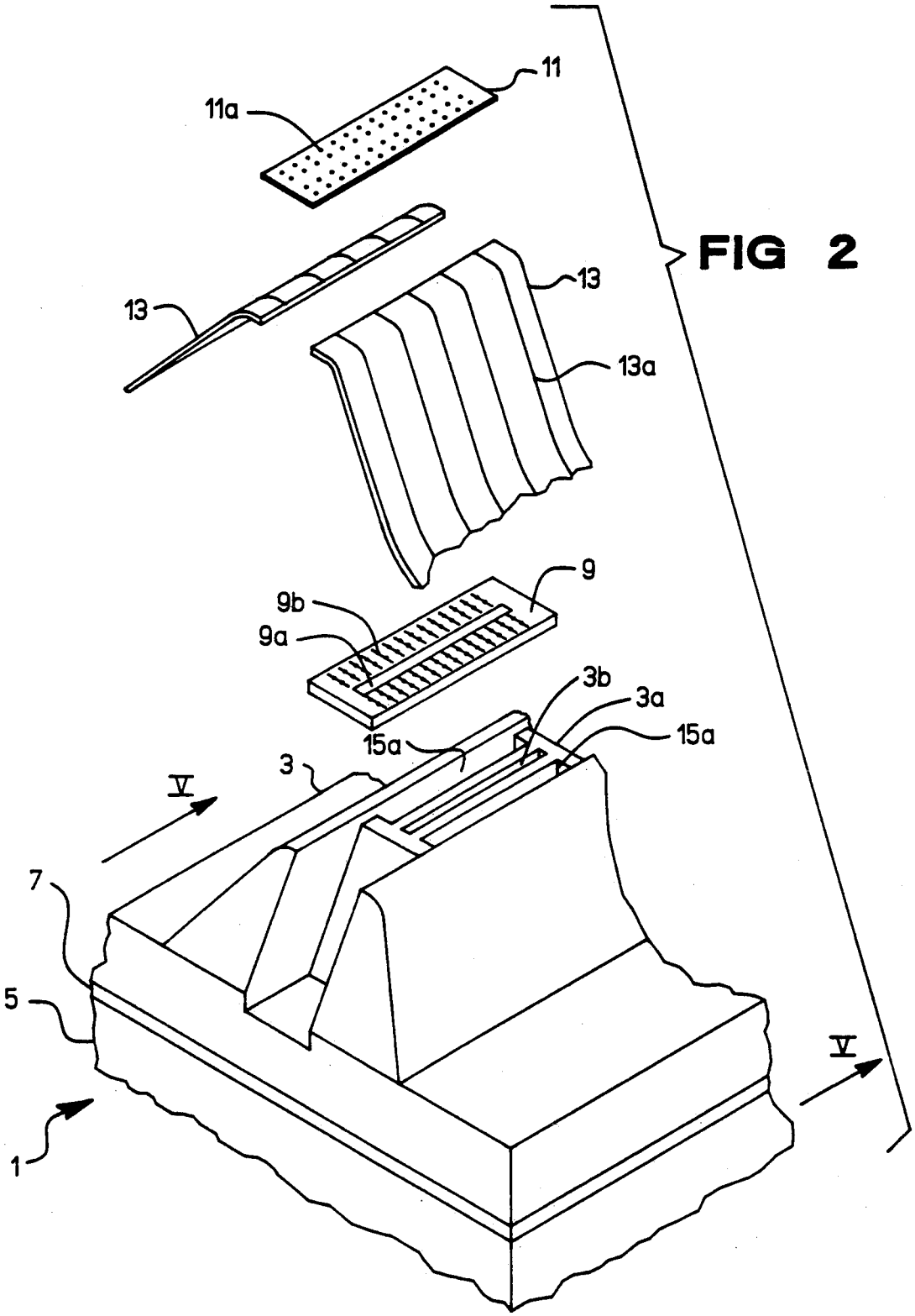
FIG. 2 is an exploded perspective view of a thermal ink jet print device embodying the principles of this invention.

One type of print device in which the invention has been practiced is illustrated, without limitation, in the exploded perspective view of FIG. 2. The print device 1 comprises a print body 3 sealed to an ink chamber 5 by means of a gasket 7 or other suitable seal. A thermal ink jet printhead 8, see also FIG. 3, comprising a resistor substrate 9 and an orifice or nozzle plate 11 are laminated together in a liquid tight relationship and fitted in a recess 3*a*, in which the resistor substrate is seated and sealed, in the upper face of the print body 3. A slot 3*b* in the recess 3*a* of the print body 3, communicates with ink in the ink chamber 5. When the printhead assembly 8 is sealed in the recess 3*a*, the slot 9*a* in the resistor plate 9 is aligned with the slot 3*b*, which admits ink from the ink chamber 5 to the back face of the nozzle plate 11. As will be seen by reference to FIG. 4, to be described, passages 11*b* in the printhead structure behind the back face of the nozzle plate 11, communicate with the ink channel or slot 9*a* in the resistor substrate 9 and admit ink into the individual ink cavities or priming cavities 11*c* at each nozzle 11*a*. Individual resistors 9*b* on the resistor substrate 9 are disposed opposite respective nozzles 11*a*. Ink directly over a resistor is vaporized and a vapor bubble is formed when the resistor is excited. As the vapor bubble grows, momentum is transferred to the ink above the bubble which expels ink from the nozzle 11*a* thereat. The resistors 9*b* are individually coupled to any of well known systems which orchestrate their firing, by means of flexible circuits 13 having individual circuit traces 13*a*, which are only fragmentarily shown, connected to the individual resistors 9*b*. As seen in FIG. 2, the flexible circuits are shaped to fit over the sloping sides of the print body 3.

Figure 3:
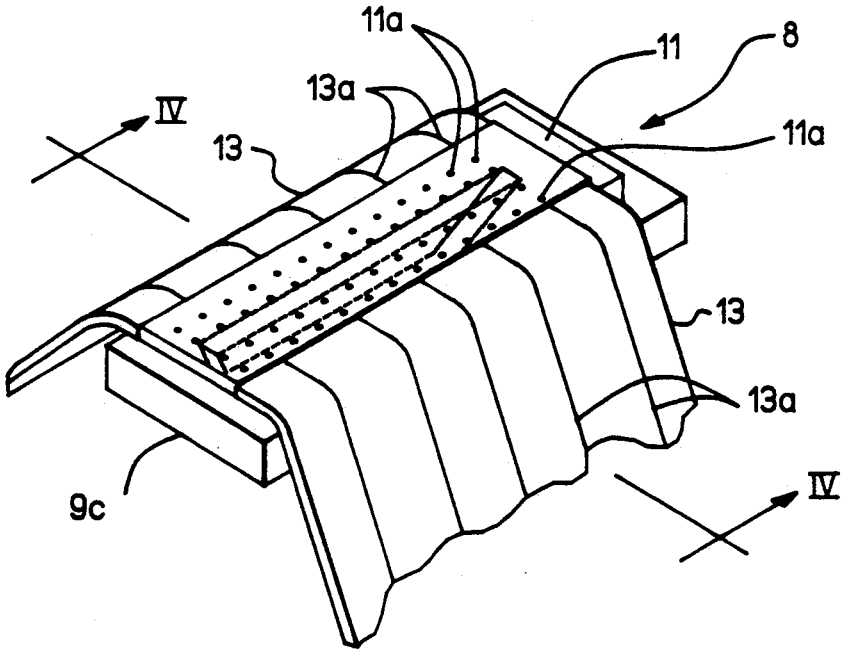
FIG. 3 is an enlarged perspective view showing the assembly of the printhead of print device of FIG. 2 and the attachment of the flexible circuit thereto.
Figure 8:
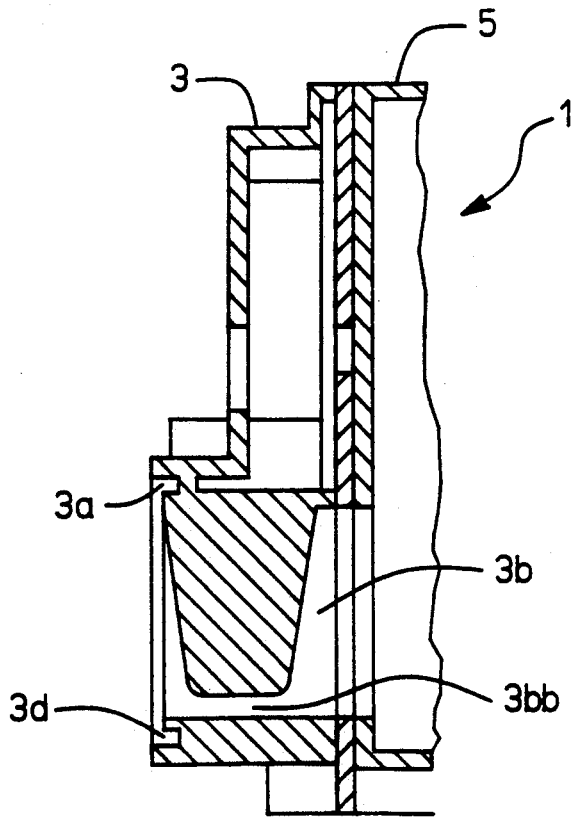
FIG. 8 is sectional view taken on the section line VIII—VIII of FIG. 6.

The print device 1 of FIG. 2 and the printhead 8 of FIG. 3 are illustrated in positions of convenience for purposes of illustration. In some applications, the print device occupies a position, such as illustrated in FIG. 8, in which the printhead body 3 and the printhead 8 are disposed substantially in a vertical plane. This position of the print device 1 provides a gravity induced flow of ink to the printhead 8. Of course other print device positions are possible.

Figure 5:
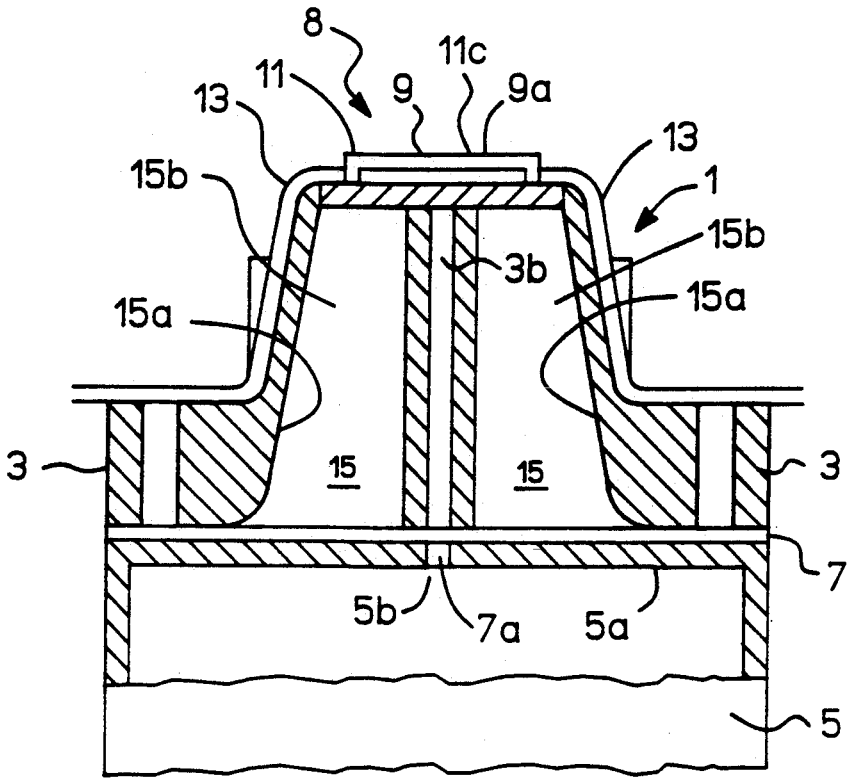
FIG. 5 is an enlarged sectional view taken in the section plane V—V of FIG. 2.

Provision for temperature control of the printhead by means of a phase change heat sink 15 is generally illustrated in FIGS. 2 and 5. The heat sink cavities 15*a* are defined within the walls of the print body 3. The open back side of the print body 3 is closed by the gasket 7 backed by an end face 5*a* of the ink chamber 5, as seen in FIG. 5. A solid material 15*b*, which has a melting point at or below the maximum acceptable printhead temperature, fills the cavity 15*a* in heat exchange relation with the back face of the substrate 9 by contact therewith.

The ink path between the ink chamber 5 and the priming cavity 11c is evident in the sectional view of FIG. 5, in which the print device 1 is shown assembled. The ink path comprises an opening 5b in the end face 5a of the ink chamber 5 and in an opening 7a in the gasket 7. Both of these openings are aligned with the slot 3b in the print body 3 which communicates with the priming cavities 11c behind the nozzle plate 11 through the slot 9a in the resistor substrate 9.

Figure 4:
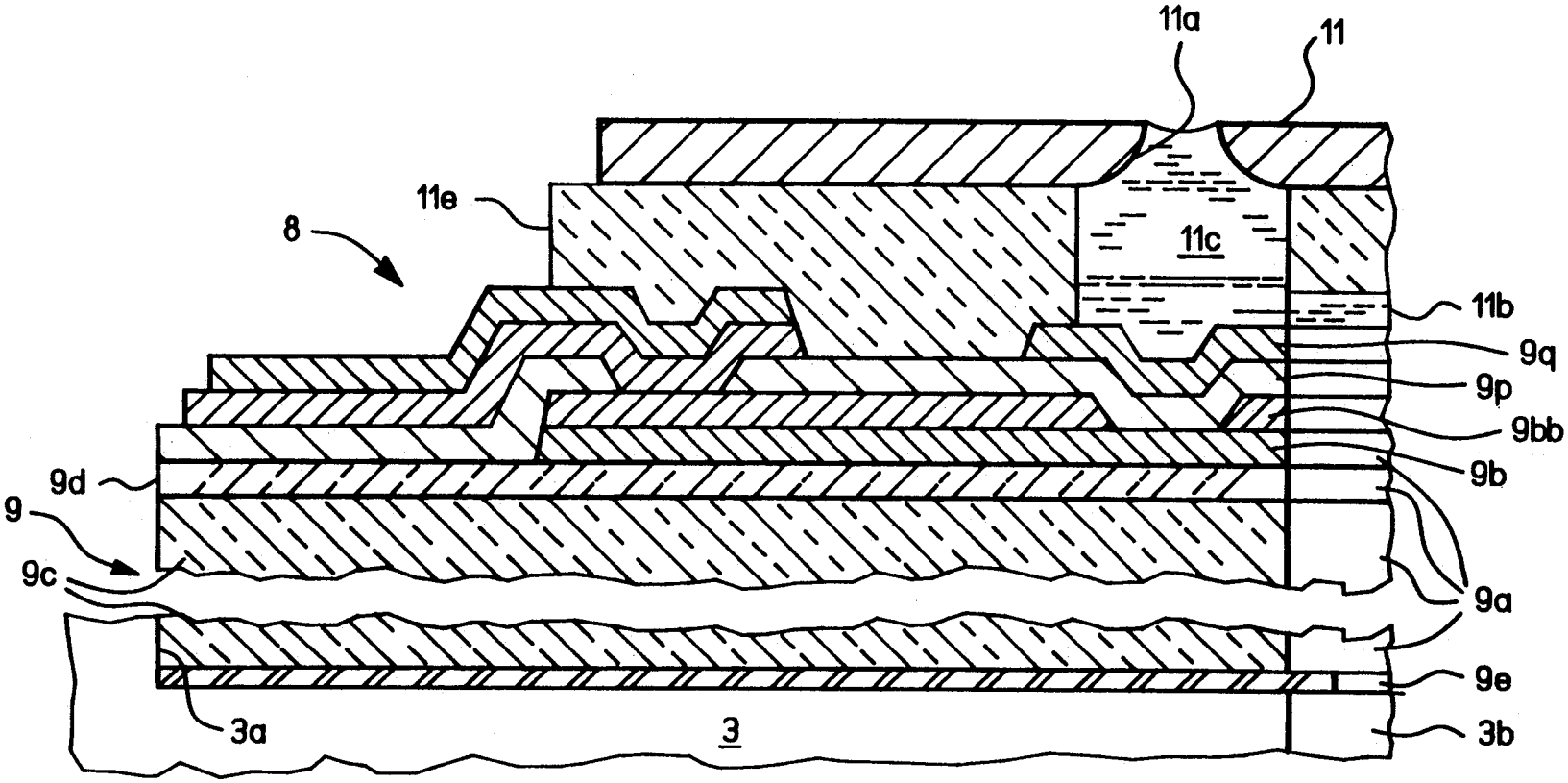
FIG. 4 is an enlarged sectional view taken in the section plane IV—IV of FIG. 3.

Further details of this ink distribution system to the individual nozzles 11a are evident in FIG. 4. This is a fragmentary sectional view taken in the section plane IV—IV of FIG. 3 and typically shows, at only one nozzle 11a, the attachment of the substrate 9, of the printhead 8, to the upper end of the print body 3, in the cavity 3a, at the slot 3b. The print body 3 is sealed to the ink chamber 5 by the gasket 7 (see FIG. 2). The printhead 8 comprises a monocrystalline silicon substrate 9c, sealed in the recess 3a, on which a silicon dioxide ($SiO_2$) layer 9d, functioning as a thermal capacitor barrier, is deposited. Individual resistors 9b of tantalum aluminum TaAl), one being shown, are deposited on the silicon dioxide layer 9d. Circuit traces or conductors 9bb for the individual resistors 9b are deposited on the resistors 9b in positions leaving the resistor portion at, or opposite, the nozzle 11a exposed. Passivation, resistor protection layers, 9p and 9q, are successively deposited on the resistor 9b. The layer 9p is of silicon carbide SiC or silicon nitride SiN. The layer 9q is tantalum Ta. The passivation layers permit heat transfer from the resistor to the ink in the priming cavity 11c while providing physical, chemical and electrical isolation from the ink.

A barrier layer 11e of a photo imageable polymer defines the ink cavities, which include the priming cavity 11c for each nozzle and a manifold passage or cavity 11b. The nozzle plate 11, usually electroformed of nickel, overlays and is sealed to the barrier layer. Individual nozzle 11a communicate with each priming cavity 11c. The approximate ink meniscus line is shown bridging the opening of the nozzle 11a. The priming cavity 11c for each nozzle 11a is joined with the others by the manifold cavity 11b. This manifold cavity 11b communicates with the slot 9a in the resistor substrate 9 which, as seen, extends through all of the substrate layers. A sealant 9e seals the resistor substrate 9 about the edge of the slot 3b and in and about the recess 3a.

Figure 7:
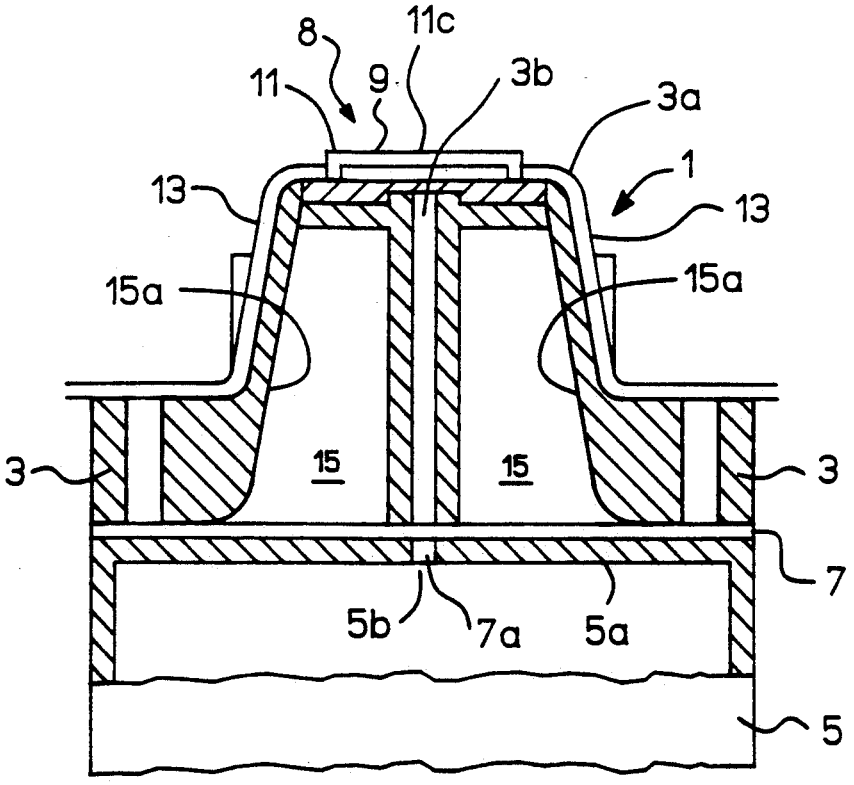
FIG. 7 is a sectional view taken on the section line VII—VII of FIG. 6.
Figure 6:
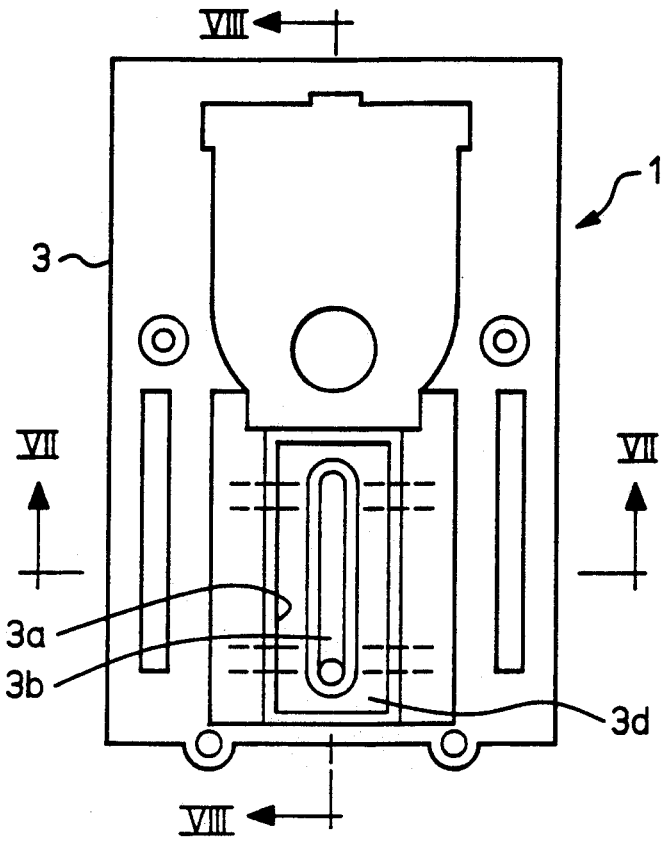
FIG. 6 is a top plan view of a modified printhead body with the printhead and flexible circuit removed for clarity.
Figure 9:
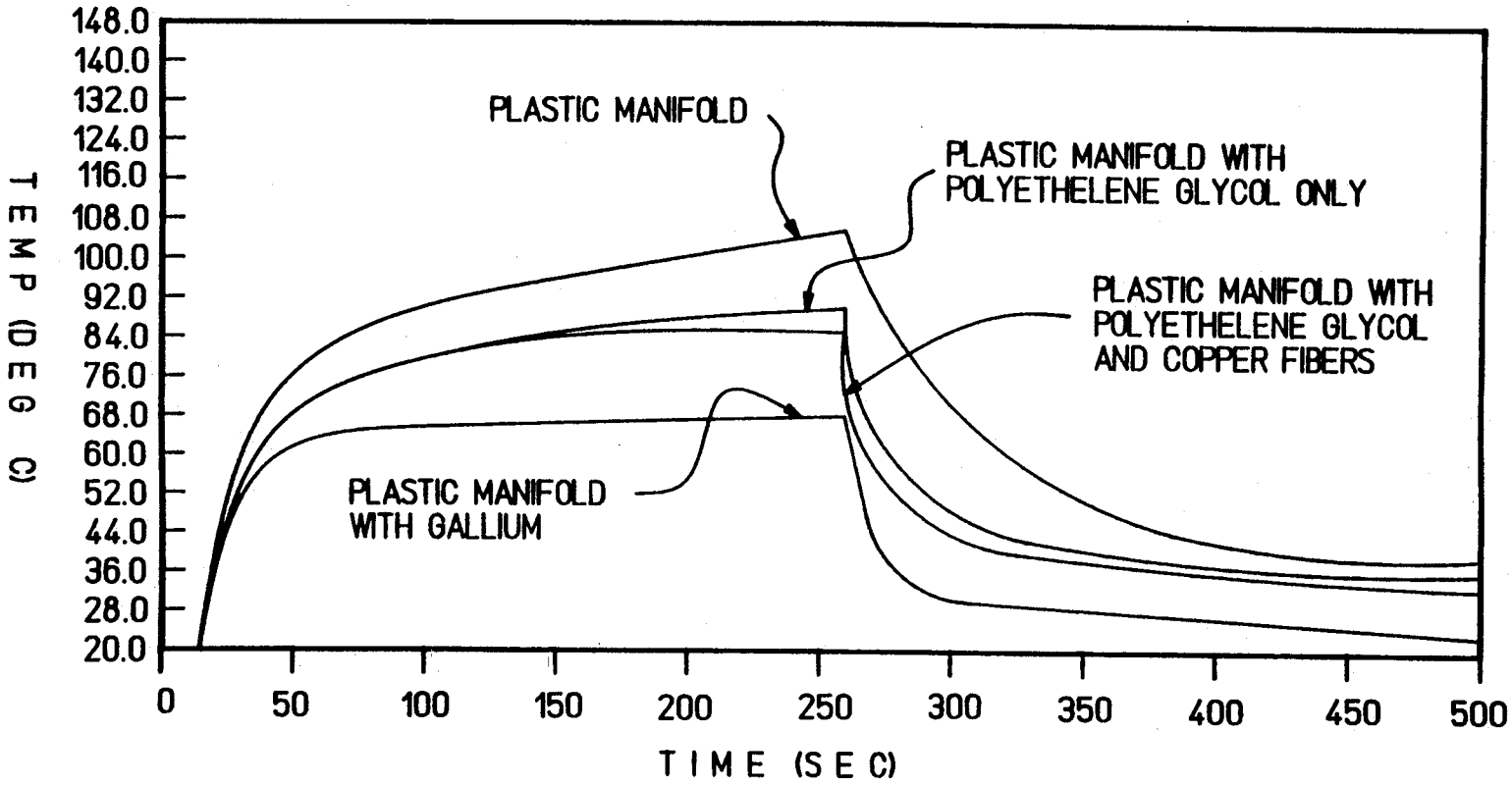
FIG. 9 illustrates plots of printhead temperatures derived from identical printhead tests without and with heat sinks using different solid materials.
Figure 10:
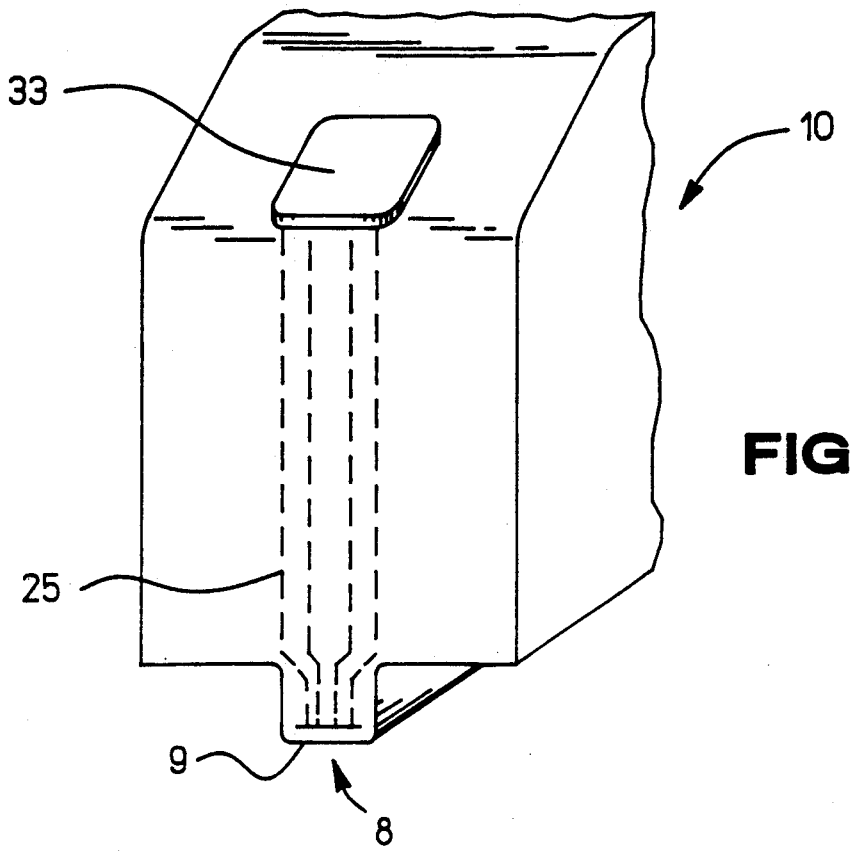
FIG. 10 is an isometric view of a different print device utilizing a printhead of the type of FIGS. 3 and 4, and embodying a heat pipe.
Figure 11:
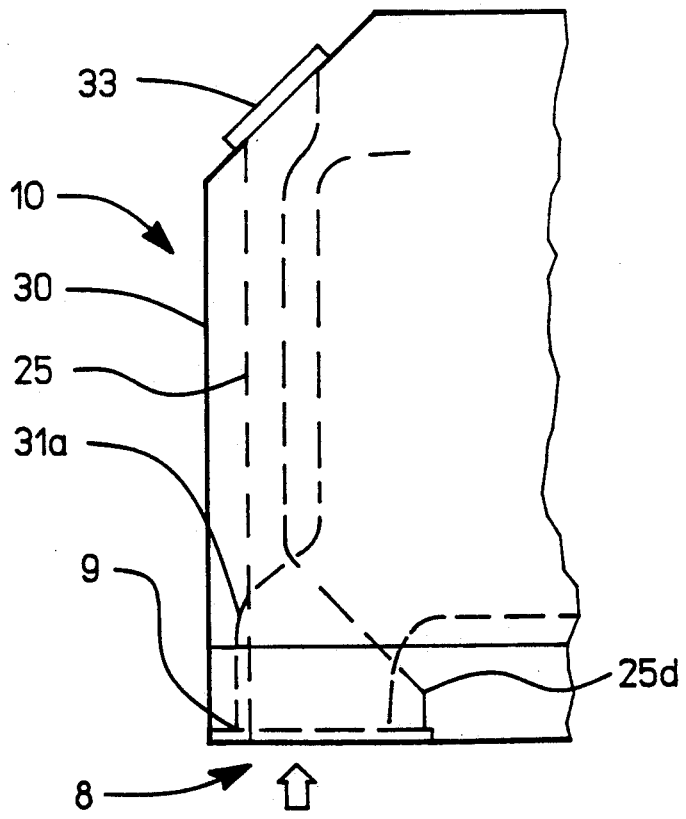
FIG. 11 is a fragmentary side elevational view of the print device of FIG. 10.
Figure 12:
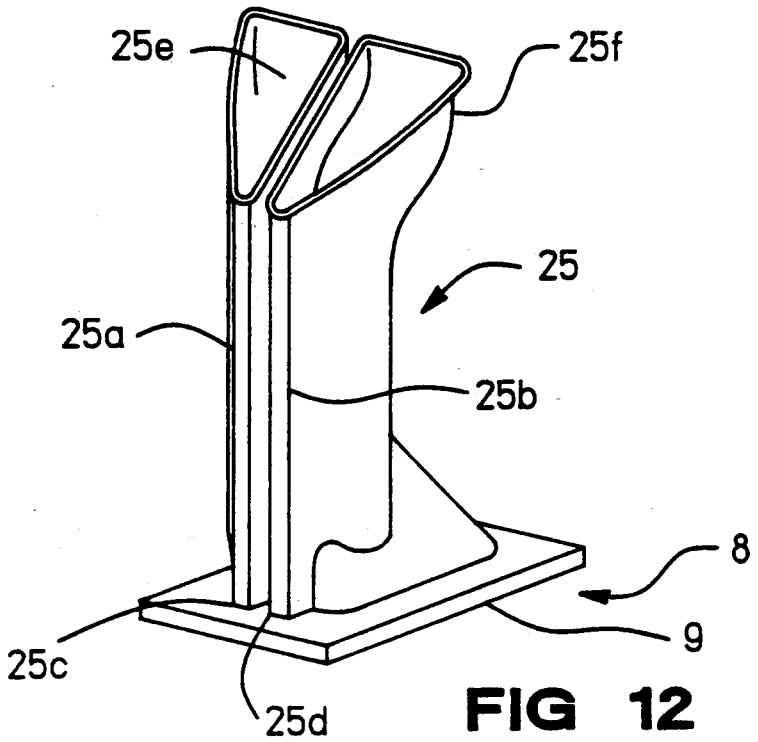
FIG. 12 is a perspective view of the heat pipe of FIGS. 10 and 11.
Figure 13:
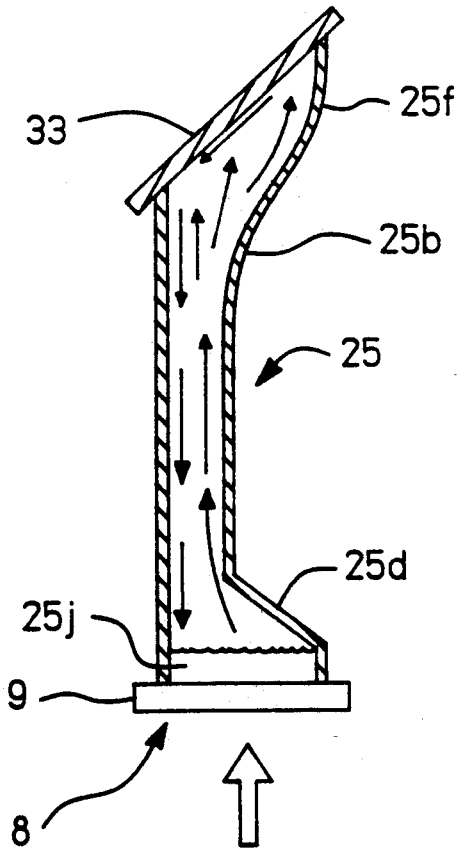
FIG. 13 is a side elevational view of the heat pipe of FIG. 12.
Figure 14:
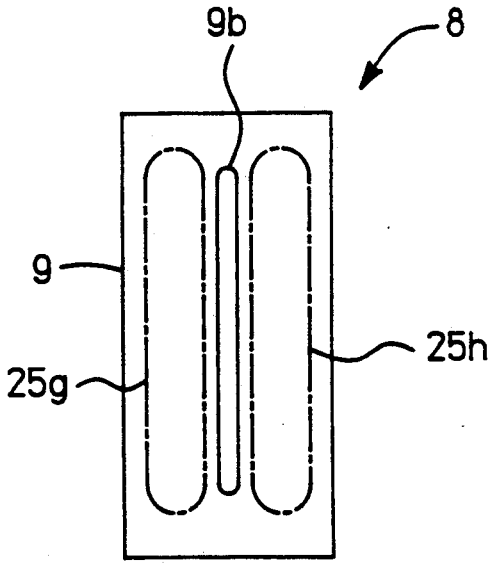
FIG. 14 is a plan view of the back side of a printhead substrate.

FIGS. 6, 7 and 8 illustrate a plastic print body 3 of the type employed in reducing this invention to practice, using a solid phase change material, from which test data depicted in the temperature plots of FIG. 9 was developed. A 300 dot per inch printhead 8 was employed. In this embodiment, the printhead recess 3a in the print body 3 is sealed from the heat sink cavities 15a in the printhead 3 by an integral end plate section 3d which closes the recess 3a except for the opening of the slot 3b. In FIG. 6, to clearly show the end plate 3d, the printhead 8 and the flexible circuits have been removed; however, in FIG. 7, the sectional view taken on the section line VII—VII of FIG. 6, these features are included. The integral end plates 3d obviate seal failures between the heat sink 15 and the printhead 8. Direct heat exchange between the resistor substrate and the phase change material 15 no longer takes place, requiring that the printhead operate at a slightly higher temperature using the same heat sink material, but this can be compensated for by selection of a heat sink material which melts at a lower temperature to compensate the thermal drop across the end plate 3d if necessary.

FIG. 8 is a sectional view taken on the section line VIII—VIII of FIG. 6. The section plane includes the longitudinal axis of the slot 3b and outlines the interior structure of the slot 3b defining the passage 3bb between the opposite sides or openings of the slot 3b. In the position of the print device 1 seen in FIG. 8, it is apparent that there is a gravity induced flow of ink to the printhead at the outer opening of the slot 3b. In addition, expelling ink from the nozzles acts as a pump to draw ink into the priming cavities of the printhead.

Solid materials which have been found to be suitable for heat sink applications include gallium and polyethylene glycol. Low temperature solder is also acceptable. The melting point of the solid phase change material which is used depends upon the specific printhead with respect to the upper limit of temperature at which the printhead may operate without unacceptable degradation of print quality. Experiments with plastic body 300 dpi printheads indicates that the upper acceptable limit of thermal ink jet printhead temperatures varies widely. Thus a solid phase change material selected for this application should in any case have a melting temperature compatible with the known upper temperature limit of a particular printhead at which acceptable print quality still exists. Experiments with the plastic body printhead indicate a requirement that the materials change physical state at a temperature below the temperature limit of the printhead and have a moderate thermal conductivity, which for solids tested are of about 10 watts per meter per degree Kelvin. Material selection, solid or liquid, depends only upon known upper limits of print head temperature. Thermal conductivity is a factor in the rate at which the change in physical state must take place to absorb the rate of delivery of heat energy.

In an experiment conducted with a 300 dpi thermal ink jet pen or printhead having a plastic case, without a provision for conducting the heat away, the printhead temperature continued to rise during printing. In a further experiment conducted with the same type of thermal ink jet pen or printhead, having a plastic case and provided with a heat sink, using gallium as the phase change material, the printhead temperature was constant at an acceptable level during printing throughout the melting period of the phase change material. The application of a heat sink employing a solid phase change material shows a remarkable improvement in thermal management based upon these experiments.

Using gallium, for example, as the phase change material in a heat sink in the same type of printhead assembly, it has been found that the printhead could be used to continuously fire in a high density print mode for 3 to 4 minutes, without exceeding the printhead's maximum operating temperature. One specific successful test was to print a 100% optical print density, A-size plot, without slowing down. A second specific successful test was to print ten (10) 50% dense A-size plots, in a row without a decrease in print quality. Again, the number of nozzles, the size of silicon substrate, the firing frequency, and the resolution (300 dpi), make a difference in performance.

The results of tests referred to above are shown in FIG. 9 which plots test data derived from tests of a 300 dot per inch print device 1, having a print body 3 of the type of FIGS. 6, 7 and 8, which is fabricated of a plastic material. The four tests were conducted without a heat sink in one case and with different heat sink materials in the other three (3) cases. All tests were conducted with this plastic print body 3, which in FIG. 9 is referred to as a manifold. The printhead 8, was fired in a high density mode for about 260 seconds as indicated and then shut down. Without a heat sink, the printhead temperature exceeded 100° C. at the end of the test interval. With a heat sink employing polyethylene glycol as the phase change material, the upper temperature reached by the printhead was lessened by about 16° C., but had an upper limit, following a gentle rise throughout the test period, which while proving the inventive concept worked, prompted the use of other materials having phase change temperatures and thermal conductivity properties better suited to the instant application. The addition of copper fibers to polyethylene glycol as indicated in the third test, improved thermal conductivity and slightly lessened the upper temperature at the end of the test interval. The final test recorded in FIG. 9 employed gallium as the heat sink material and showed a remarkable improvement in the thermal management compared with the control case which used only the plastic print body 3 or manifold. In the last test, once the gallium began to melt, the printhead temperature was constant during the test interval.

FIGS. 10–14 illustrate a heat pipe and its application to a print device 10. In these figures, parts corresponding to those of FIGS. 2–8, bear like reference characters. The print device 10 comprises a body 30 which contains an ink bladder 31, FIG. 11. A printhead 8 having a substrate 9 is sealed in a recess in the body 30. The ink bladder 31 has a neck portion 31*a*, FIG. 11, the outlet of which is sealed marginally about the slot 9*b*, see FIG. 14, on the back face of the substrate 9 of the printhead 8. In this position ink in the bladder 31 communicates with the slot 9*b* to supply ink to the priming cavities 11*c* and to the nozzles 11*a* of the nozzle plate 11, see FIG. 4.

A heat pipe 25 is disposed within the body 30 of the print device 10. The heat pipe comprises a pair of tubes 25*a* and 25*b*, which may be joined together above bladder neck 31*a*, each of which has a lower end, respectively, 25*c* and 25*d*, and respective open, enlarged upper ends 25*e* and 25*f*. The lower ends, 25*c* and 25*d*, are also open and are adhesively bonded and sealed at their extremities, by an epoxy type of sealant, for example, to the back face of the substrate 9, in positions denoted by the dot dash outlines, 25*g* and 25*h*, on opposite sides of the ink feed slot 9*a* and the neck 31*a* of the bladder 31, shown in FIG. 14. The open upper ends, 25*e* and 25*f*, are similarly bonded and sealed to a cold junction comprising a plate 33 of high thermal conductivity, such as aluminum or copper, here shown projecting from an upper sloping face of the body 30 of the print device 10, to reject heat to the ambient environment or to a cold junction metal clamp on the plate 33, such as a highly conductive thermal mass on the body 30. A heat pipe fluid 25*j* in the bottom end of each heat pipe tube, 25*a*, 25*b*, is in contact with the back face of the substrate 9, the wetted area being defined within the dot-dash outlines 25*g* and 25*h*. These areas are as large as substrate space permits to maximize area exposure of the heat pipe fluid to the substrate 9.

As in the case of the solid phase change materials, heat energy generated in the substrate 9 by the firing of the resistors 9*b*, produces a physical change. In this case the heat pipe fluid is vaporized. The warm vapor rises upwardly in the heat pipe tubes 25*a* and 25*b*, as indicated by the dotted arrows of FIG. 13. In the enlarged upper ends, 25*e* and 25*f*, of the heat pipes, 25*a* and 25*b*, the vapor contacts the inner face of the cold junction plate 31 where it is cooled and changes phase state, returning to a fluid, which as shown by the solid arrows flows down the walls of the heat pipe tubes to the fluid supply 25*j*.

In one embodiment, the heat pipes were pressurized and each contained about 1 *cc* of fluid, 25*j*. Pressure ranges, P, in atmospheres for 0° C. to 70° C. are given for each fluid listed in the table below.

| | Temp | |
|---|---|---|
| | 0° C. | 70° C. |
| | Pressure P (atm) | |
| Freon 11 | 0.4 | 4.0 |
| Freon 13 | 0.1 | 2.0 |
| Methanol | 0.05 | 1.8 |
| Ethanol | 0.01 | 0.75 |
| I.P. Alcohol | 0.005 | 0.35 |
| Pentane | 0.02 | 3.0 |

The heat rate = $\dot{m}\, h_{fg}$
where $\dot{m}$ = mass flow rate in grams/sec. and $h_{fg}$ = heat of evaporation in Joules/gram.
For Freon, the heat of evaporation $h_{fg}$ is 180 J/g.

These teachings herein indicate that the selection of a phase change material is simply based upon the upper limit of printhead temperature together with a thermal conductivity of the material compatible with the heat rate to provide a change in physical state of the phase change material at a rate commensurate with the rate at which heat energy is developed.

Although the invention has been described in its application to print devices having plastic print bodies, the principles taught herein are, at least, equally advantageously applied where metallic print bodies are employed. Although specific phase change materials, solids and fluids, have been named and data presented with respect thereto, other materials for known printhead temperature limits, and rates at which heat energy is generated, are easily selected from available tables of physical properties for materials. Additionally, changes in physical state, such as the glass transition of a material, within the temperature ranges of acceptable print quality, are contemplated and usable for cooling purposes.

What is claimed is:

1. A thermal ink jet print device, comprising:

a body having a first cavity containing ink and having a second cavity containing a phase change material;

a rectangular printhead having a plurality of nozzles through which ink is ejected, said printhead having a rectangular back face disposed on said body adjacent said first cavity and said second cavity, said rectangular back face having a length dimension larger than a width dimension, said rectangular printhead having a length-wise slot formed through said back face and substantially centered with respect to said width dimension of said back face so as to divide said back face into a first half and a second half, said slot being in fluid communication with said first cavity via an ink passage for allowing ink to flow into priming cavities, each priming cavity being associated with one of said nozzles;

electrical heating means at each priming cavity for each nozzle of the plurality of nozzles, each electrical heating means when heated ejecting ink from the priming cavity through the nozzle thereat;

said second cavity comprising a first half portion and a second half portion, said first half portion having a first wall only contacting said first half of said back face of said printhead, said second half portion having a second wall only contacting said second half of said back face of said printhead, said ink passage, in fluid communication with said slot, running between said first half portion and said second half portion of said second cavity, said phase change material in said second cavity having two physical states with change from one physical state to the other physical state in the presence of printhead heat energy at a predetermined printhead temperature below that at which unacceptable printing occurs, said phase change material in said second cavity being in heat exchange relationship with said back face of said printhead to be exposed to and to absorb printhead heat energy in changing physical state, said phase change material existing in both physical, states during phase change cooling and having a rate of change of physical state at said predetermined temperature which is substantially commensurate with the rate of delivery of heat energy by said printhead.

2. The invention according to claim 1 in which:

said phase change material is a solid which has a melting point below printhead temperatures at which printing degrades.

3. The invention according to claim 1 in which said phase change material is a solid which has a melting point in the range of about 35° to 85° C. and has a thermal conductivity of about ten (10) watts per meter per degree Kelvin.

4. The invention according to claim 1 in which said phase change material is gallium.

5. The invention according to claim 1 in which said phase change material is polyethylene glycol.

6. The invention according to claim 1 in which said phase change material is low temperature solder.

7. The invention according to claim 1 in which said body is plastic.

8. The invention according to claim 1 in which said body is metal.

9. The invention according to clam 1, in which:

said second cavity comprises at least one heat pipe structure in a substantially upright position in said body, having a bottom hot junction disposed in heat exchange relationship with said back face of said printhead and an upper cold junction for rejecting heat energy from said body, and said phase change material is a fluid within said heat pipe structure pooled at said hot junction in heat exchange relationship with said back face of said printhead, which vaporizes at a temperature below that at which print degradation occurs and which vaporizes at a rate substantially commensurate with the rate of delivery of heat energy from said printhead, whereby vapor rises in said heat pipe structure, condenses in contact with said cold junction and flows down a wall of said heat pipe structure to said hot junction.

10. The invention according to claim 9, in which:

said back face of said printhead is connected directly to said heat pipe structure at said hot junction, and said fluid is in contact with said back face of said printhead.

11. The invention according to claim 10, in which:

said fluid is freon.

12. The invention according to claim 10, in which:

said fluid is methanol.

13. The invention according to claim 10, in which:

said fluid is ethanol.

14. The invention according to claim 10, in which:

said fluid is I.P. alcohol.

15. The invention according to claim 10, in which:

said fluid is pentane.

* * * * *